US008388405B2

(12) United States Patent
Desent et al.

(10) Patent No.: US 8,388,405 B2
(45) Date of Patent: Mar. 5, 2013

(54) TOY LAUNCHER AND DUAL POWERED TOY

(75) Inventors: Nash Desent, North Kingstown, RI (US); John Boyce, Willington, CT (US)

(73) Assignee: Hasbro, Inc., Pawtucket, RI (US)

( * ) Notice: Subject to any disclaimer, the term of this patent is extended or adjusted under 35 U.S.C. 154(b) by 573 days.

(21) Appl. No.: 12/609,267

(22) Filed: Oct. 30, 2009

(65) Prior Publication Data

US 2011/0104981 A1 May 5, 2011

(51) Int. Cl.
*A63H 27/14* (2006.01)
*A63H 17/18* (2006.01)

(52) U.S. Cl. ..... 446/429; 446/462; 446/430; 446/457

(58) Field of Classification Search ..... 446/429, 446/430, 462, 457

See application file for complete search history.

(56) References Cited

U.S. PATENT DOCUMENTS

| | | | | | |
|---|---|---|---|---|---|
| 3,693,282 | A | | 9/1972 | Adicks et al. | |
| 3,701,216 | A | | 10/1972 | Smith, III et al. | |
| 3,803,756 | A | * | 4/1974 | Strongin | 446/429 |
| 3,886,682 | A | * | 6/1975 | Ieda et al. | 446/429 |
| 3,932,957 | A | * | 1/1976 | Morrison et al. | 446/234 |
| 4,016,674 | A | * | 4/1977 | Resnick et al. | 446/409 |
| 4,363,186 | A | * | 12/1982 | Goldfarb et al. | 446/429 |
| 4,403,440 | A | | 9/1983 | Wulff | |
| 4,418,495 | A | | 12/1983 | Kennedy et al. | |
| 4,472,906 | A | | 9/1984 | Cook et al. | |
| 4,483,096 | A | | 11/1984 | Gabler et al. | |
| 4,501,567 | A | * | 2/1985 | Cathell | 446/430 |
| 4,511,342 | A | * | 4/1985 | Hart et al. | 446/429 |
| 4,529,389 | A | * | 7/1985 | Kennedy et al. | 446/26 |
| 4,690,654 | A | | 9/1987 | DeLaney | |
| 4,732,569 | A | | 3/1988 | Hippely et al. | |
| 4,756,703 | A | * | 7/1988 | Kennedy et al. | 446/26 |
| 4,946,417 | A | | 8/1990 | Ishikawa et al. | |
| 4,959,035 | A | | 9/1990 | Murasaki | |
| 5,254,030 | A | | 10/1993 | Ostendorff et al. | |
| 5,316,514 | A | * | 5/1994 | Ellman et al. | 446/26 |
| 5,525,085 | A | | 6/1996 | Liu | |
| 5,643,036 | A | * | 7/1997 | Liu et al. | 446/23 |
| 5,823,848 | A | * | 10/1998 | Cummings | 446/429 |
| 7,445,539 | B2 | * | 11/2008 | Laurienzo et al. | 446/429 |
| 7,568,578 | B2 | * | 8/2009 | Berman | 206/335 |
| 7,682,218 | B2 | * | 3/2010 | Yu et al. | 446/440 |
| D637,661 | S | * | 5/2011 | Horikoshi | D21/461 |
| 2008/0166947 | A1 | | 7/2008 | Bernstein et al. | |
| 2009/0075556 | A1 | | 3/2009 | Sun et al. | |

* cited by examiner

*Primary Examiner* — Gene Kim
*Assistant Examiner* — Urszula M Cegielnik
(74) *Attorney, Agent, or Firm* — Perry Hoffman

(57) ABSTRACT

A toy launcher and dual powered toy vehicle apparatus where the toy launcher includes a base part to be held stationary during operation and a slidable part mounted to the base part, the slidable part being movable between first and second positions. Captured between the base and slidable parts is a spring. The expanding spring causes the toy vehicle to be propelled away from the launcher. At the same time, the rapid movement of the rack energizes the flywheel motor so that after the spring discharges the toy vehicle and a flywheel of the flywheel motor engages a supporting surface, the toy vehicle is moving in response to both the spring and the flywheel motor, two different power sources. The single action of pulling the rack appears to the user to cause compression and release of the spring, and the flywheel motor to be energized, essentially simultaneously.

19 Claims, 7 Drawing Sheets

TOY LAUNCHER AND DUAL POWERED TOY

FIELD OF THE INVENTION

The present invention relates generally to a toy apparatus, and more particularly, to a toy apparatus including a structure to be propelled and a launcher assembly whereby the structure, such as a toy vehicle, is propelled by a combination of a spinning flywheel and an expanding compressed spring.

BACKGROUND OF THE INVENTION

Toy vehicles have generally been a consistent play item for young boys because the toy vehicles have excellent play value. Propelling toy vehicles have varied from simply providing a manual push on a hard level playing surface to using gravity by placing roadway tracks at a high elevation. Propelling toy vehicles have also included mechanical power sources such as springs, and windup and flywheel motors, and electrical power sources.

In general toy vehicles and vehicle launchers are well known. For example, a 1972 U.S. Pat. No. 3,693,282, listing Adicks et al., as inventors, issued for a "Toy Vehicle Launching Device With Safety Mechanism" and purports to disclose a device for launching a toy vehicle, the device having a spring actuated piston and a latch bar for locking the piston in a cocked position. A vertical leg and a cross bar safety feature prevent operation of a button to pivot the latch bar out of a piston blocking position. When the device is held firmly against a support surface in a launch position, the leg and cross bar are raised and the button may be pressed to release the piston and propel the vehicle. Another 1972 U.S. Pat. No. 3,701,216, listing Smith et al., as inventors, issued for a "Wheel Apparatus And Rack And Pinion Launcher Enabling Repeated Strokes And Having Automatic Ejector" and purports to disclose a toy launcher with an output shaft and a gear train where the gear train is operated with a slidable gear rack which is hand manipulated. An ejector is mounted to the output shaft to force a shaft-mounted wheel of a vehicle off the shaft after the rack has energized the shaft.

A 1983 U.S. Pat. No. 4,403,440, listing Wulff as the inventor issued for a "Toy Vehicle Accelerator" and purports to disclose a device for launching a toy vehicle using an impeller and a spring. A second 1983 U.S. Pat. No. 4,418,495, listing Kennedy et al., as inventors, issued for a "Miniature Racing Vehicle And Wrist-Borne Launching Platform Assembly" and purports to disclose a wrist-borne launcher with a retractable ramp and a transparent covering hanger for a windup spring powered toy vehicle. The vehicle is held in place by friction-engaging elements mounted to the sides of the hanger. A push-button actuator mounted on the rear of the hanger engages the rear of the vehicle and when operated, pushes the vehicle free of the friction engaging elements allowing the windup spring to power the vehicle away from the launcher.

A year later, U.S. Pat. No. 4,472,906, listing Cock et al., as inventors, issued for a "Manually Activated Toy Vehicle Launcher" and purports to disclose a two piece launcher where one piece is slidable in one direction relative to the other piece and when quickly pushed in an opposite direction by a user, a toy vehicle is discharged. Another 1984 U.S. Pat. No. 4,483,096, listing Gabler et al., as inventors issued for a "Launching Platform For Inertia Vehicle" and purports to disclose an energizer and launcher for a toy vehicle having an inertia motor, such as a flywheel. The launcher includes a drawstring energizing mechanism mounted in the launcher and connected to the toy vehicle whereby a number of pulls on the drawstring energizes the inertia motor. The toy vehicle is then manually released. A 1987 U.S. Pat. No. 4,690,654, listing DeLaney as inventor issued for a "Toy Vehicle Carrying Case And Launcher" and purports to disclose a toy vehicle carrying case and launcher having a clip to attach the carrying case to a user's belt. The case is configured from two elements, a first element rotatably mounted to a second element so that when carried, the toy vehicle is enclosed. In operation, when the toy vehicle is initially loaded into the second element a launch spring is compressed. Pressing a spring-operated button opens the case to set up the toy vehicle for launch, and pressing a second button releases the launch spring to discharge the toy vehicle.

In 1988, a U.S. Pat. No. 4,732,569, listing Hippely et al., as inventors issued for a "Toy Vehicle Launcher" and purports to disclose a launcher for a toy vehicle having a flywheel motor. In operation, the toy vehicle is mounted to a launcher slide connected to a spring, and the toy vehicle and slide are retracted to tension the spring. Within the launcher is a set of wheels and a gear. The toy vehicle has a set of wheels that engage the launcher wheels. The launcher wheels are made to rotate by pulling on a flexible rack. At the end of the rack is a cam that is configured to engage a cam formed on the launcher so as to distort a portion of the launcher to release the toy vehicle. According to the disclosure, the spring loaded slide moves the toy vehicle along the launcher, and as the toy vehicle is pulled forward by the slide, the launcher wheels cause the rear wheels of the toy vehicle to rotate and provide the necessary energy to the flywheel motor of the toy vehicle.

A 1990 U.S. Pat. No. 4,946,417, listing Ishikawa et al., as inventors issued for a "Running Toy Shooting Apparatus" and purports to disclose a toy vehicle with a flywheel and a launcher with a draw string. The apparatus also includes a spring driven holder member. In operation, a user manually places the toy vehicle on the launcher and pushes against the holder member so as to tension a spring. The string is then pulled to energize the flywheel, and a button is pushed to release the toy vehicle. The forward movement of the holder member and the high rotational velocity of the flywheel result in a high initial toy vehicle velocity. A second 1990 U.S. Pat. No. 4,959,035, listing Murasaki as an inventor issued for a "Miniature Storage Container For A Manually Propelled Toy Member" and purports to disclose a toy apparatus including a flat rectangular toy case and a removable toy vehicle carried in the case. Several embodiments show the toy vehicle being energized with a pull rack, and one embodiment shows a toy vehicle being launched with a spring biased push member.

A 1993 U.S. Pat. No. 5,254,030, listing Ostendorff et al., as inventors issued for a "Rapid Action Toy Vehicle Launcher" and purports to disclose a toy vehicle launcher which is fed by two lines of toy vehicles located on two spaced apart tracks in the form of a "V." A pivotal carriage moves between the two tracks and alternately launches toy vehicles with a spring-biased striker that is placed in tension at the same time that the carriage is realigned with one of the tracks. A 1996 U.S. Pat. No. 5,525,085, listing Liu as an inventor issued for a "Sparking Toy Vehicle And Launcher Therefore" and purports to disclose a toy apparatus including a sparking toy vehicle and a launcher having a push handle for inducing the sparks, and a spring-biased plunger for propelling the vehicle. A U.S. patent application published in 2008, No. 2008/0166947, listing Bernstein as an inventor for a "Spring-Powered Toy Vehicle And Launcher" purports to disclose a two part toy apparatus where a rear body portion is spring loaded to a front body portion so that when pulled apart and released the rear body portion moves toward the front body portion and propels the vehicle. In addition, a launcher to which the toy vehicle may be mounted includes a plunger and a spring biased plunger handle. When the handle is pulled back and released an additional source of power is provided for launching the toy vehicle. Lastly, a U.S. patent application published in 2009, No. 2009/0075556, listing Sun et al., as inventors for a "Vehicle Launcher Assembly" purports to disclose another two part toy apparatus including an outer vehicle operated by hand and an inner vehicle. When the inner vehicle is loaded into the outer vehicle a spring is compressed. Later when the outer vehicle is opened to expose the inner vehicle, a user may push a button to release the spring and propel the inner vehicle away from the outer vehicle. Examples of the inner and outer vehicles include a batmobile outer vehicle and a batman riding motorcycle for the inner vehicle.

These disclosures are interesting, but none disclose a simply operated device that allows a toy vehicle to be launched using two power sources where both are energizes at essentially the same time using the same launch structure.

SUMMARY OF THE INVENTION

In accordance with the present invention, an advantageous apparatus is provided that enhances the play value of mechanical toy vehicles. The present invention also provides an advantageous method for manufacturing the toy vehicle as well as its launcher assembly. A described preferred embodiment set forth below includes a toy vehicle and its launcher assembly where the toy vehicle is propelled away from the launcher assembly by an expanding compressed spring and a flywheel motor and the flywheel motor and the spring are energized almost simultaneously by pulling on a single item, an elongated gear rack. The present invention is simple, robust, easy to use, inexpensive, compact and efficient. The present invention also has other important features: thrust is added to the propelled toy vehicle and accurate aiming of the toy vehicle is enhanced.

Briefly summarized, the invention includes a structure to be propelled and a launcher apparatus. The launcher apparatus includes a launcher assembly having a first part, a second part slidably mounted to the first part, a spring mounted between the first and second parts for biasing the second part when the spring is compressed, and an elongated rack having gear teeth and a flexible tab with a protrusion. The apparatus also includes the structure to be propelled for mounting to the launcher assembly, the structure to be propelled including a flywheel motor, wherein the structure is propelled from the launcher assembly by rapidly expanding the compressed spring and by the flywheel motor which are both operated by the elongated rack.

The invention also relates to a method for manufacturing a toy apparatus including the steps of forming a structure to be propelled having a flywheel motor, and forming a launcher assembly having a base part intended to be stationary in operation, a slidable part being movable between first and second positions relative to the base part, a spring positioned between the base part and the slidable part for rapidly pushing the slidable part from the second position to the first position, and an elongated rack, wherein the structure to be propelled is mounted to the slidable part, wherein inserting the elongated rack into the structure to be propelled and pulling the elongated rack enables the flywheel motor to be energized, the slidable part to be moved from the first position to the second position whereby the spring is compressed, and the spring to be released.

BRIEF DESCRIPTION OF THE DRAWINGS

For the purpose of facilitating an understanding of the invention, the accompanying drawings and description illustrate a preferred embodiment thereof, from which the invention, its structures, its construction and operation, its processes, and many related advantages may be readily understood and appreciated.

DETAILED DESCRIPTION OF THE EMBODIMENTS

The following description is provided to enable those skilled in the art to make and use the described embodiment set forth in the best mode contemplated for carrying out the invention. Various modifications, equivalents, variations, and alternatives, some of which are set forth below, however, will be readily apparent to those skilled in the art. Any and all such modifications, variations, equivalents, and alternatives are intended to fall within the spirit and scope of the present invention.

Figure 1:
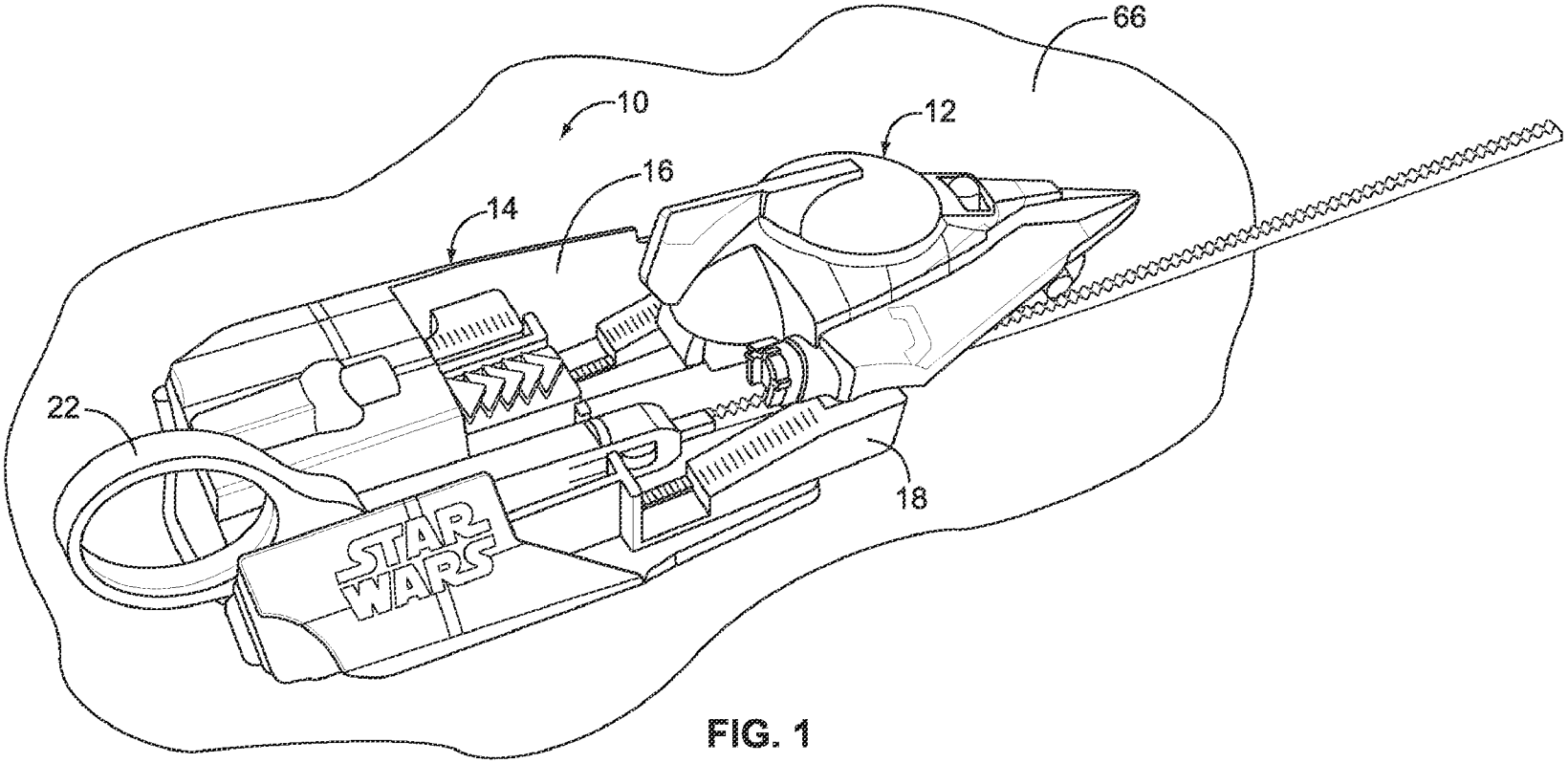
FIG. 1 is an isometric view of a preferred embodiment of the inventive toy apparatus including a dual powered toy vehicle and a launcher assembly.

Referring now to FIG. 1, there is illustrated a preferred embodiment of the invention in the form of a toy apparatus 10 that includes a toy vehicle 12 mounted to a launcher assembly 14. The launcher assembly includes first and second engagable parts 16, 18, a spring 20, FIG. 5, and an elongated pull rack 22. A major advantage of the present invention is that the toy apparatus 10 provides two power sources for propelling the toy vehicle 12 and that they are operated at essentially the same time by the same manual activity of a user. One source is a flywheel motor within the toy vehicle 12 and the other source is built into the launcher assembly 14 in the form of a released or expanding compressed spring 20. Unlike earlier toy devices where there may also be flywheel and/or spring arrangements, the spring is compressed separately at a time when the toy vehicle is mounted to a launcher, and the flywheel is separately energized before a button is pressed to release the spring or the toy vehicle. The launcher includes the elongated pull rack and the toy vehicle includes the flywheel motor energized thereby.

In operation, a user positions the pull rack adjacent the flywheel motor and aligns the pull rack in the launcher. When the pull rack is rapidly jerked rearward, the protrusion causes the slidable part to be moved from its first or extended position to its second or retracted position resulting in the spring being compressed. Continued pulling of the rack rearward causes the protrusion to bias the tab away from engagement with the launcher resulting in a release of the compressed spring. In the present invention, a single operation of quickly pulling on the rack energizes directly the flywheel motor in the toy vehicle 12, compresses the spring 20, and then releases the spring 20, where these three events are happening almost simultaneously. The user of the toy apparatus operates only the pull rack to activate the two power sources for the toy vehicle. It should be noted, and in the alternative, the toy vehicle represents a structure to be propelled and instead of the toy vehicle, other structures, such as a ball or a roller having flywheel or windup motors, may be used.

Figure 2:
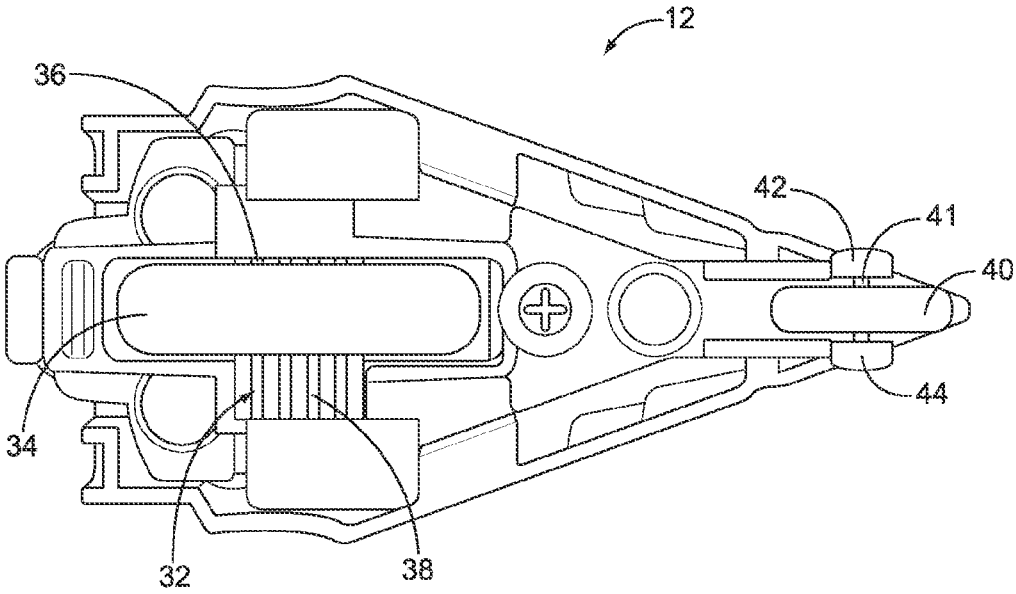
FIG. 2 is a bottom plan view of the toy vehicle shown in FIG. 1.
Figure 3:
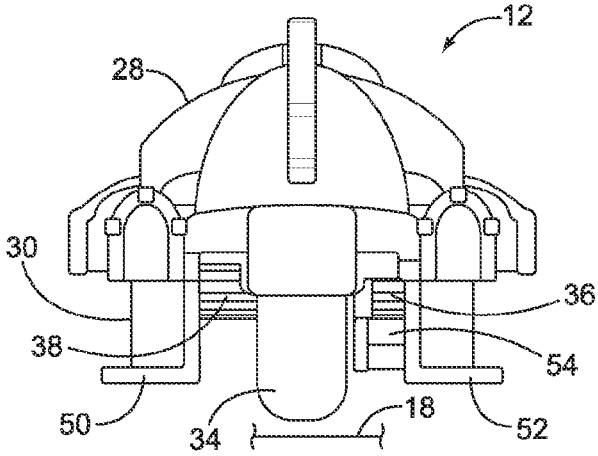
FIG. 3 is a rear elevation view of the toy vehicle shown in FIGS. 1 and 2.

Referring now to FIGS. 2 and 3, in addition to FIG. 1, the toy vehicle 12 includes a connected body portion 28 and chassis 30. Mounted to the chassis 30 is a flywheel motor 32 that includes a flywheel 34, with the flywheel also functioning as a rear wheel of the toy vehicle, and oppositely positioned pinion gears 36, 38. The flywheel 34 and the pinion gears 36, 38 are mounted to a freely rotating or low friction shaft (not directly shown). Also supported by the chassis 30 is a small front wheel 40 mounted to a low friction shaft 41 supported by a pair of downward extending brackets 42, 44, the toy vehicle 12 being supported during movement by the two wheels 34, 40. The chassis 30 is configured to include two oppositely positioned L-shaped arms or supports 50, 52 that are used to mount the toy vehicle 12 to the second part 18 of the launcher assembly 14 such that the flywheel 34 is spaced away from, or out of direct contact with, the launcher assembly prior to launch as shown in FIG. 3. The chassis 30 is also configured to include a tubular passageway 54 for mounting and guiding the pull rack 22 in relation to the pinion gear 36. The body portion 28 is configured as a futuristic vehicle, but in the alternative, the toy vehicle may be configured in any convenient form, such as a contemporary or antique car, a plane, a ship, or a tank, or the structure to be propelled may be configured not as a vehicle but as an animal or a human. The toy vehicle may also, in the alternative, have additional wheels, runners, skids or threads, if desired. The body and chassis of the toy vehicle may be made from any suitable material, such as a synthetic resin.

Figure 4:
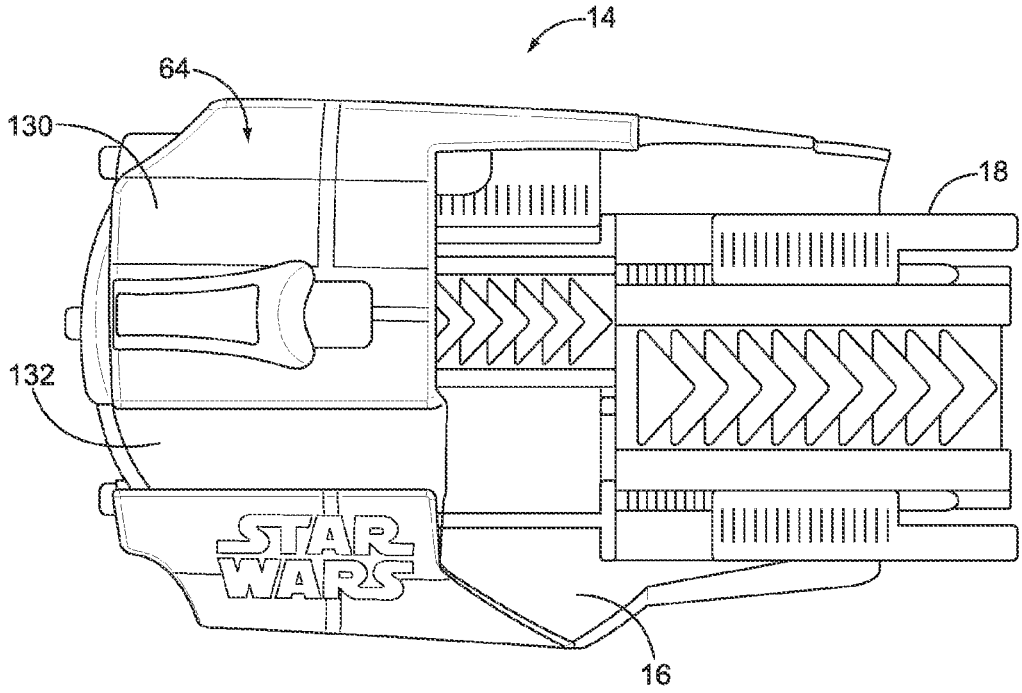
FIG. 4 is a top plan view of the launcher assembly shown in FIG. 1, but without a pull rack.
Figure 5:
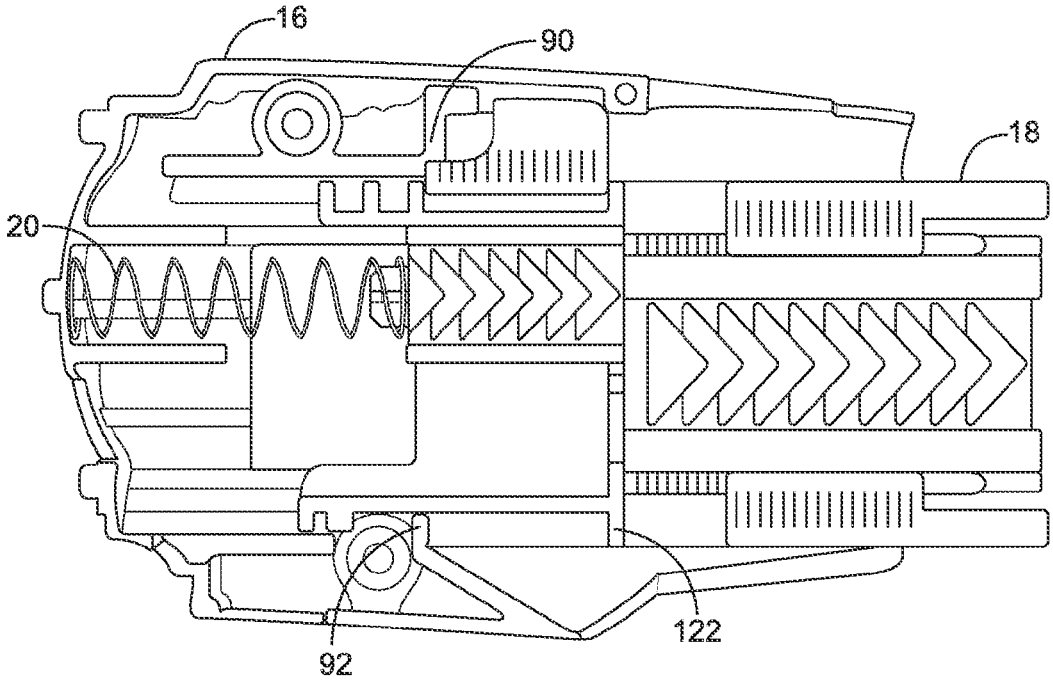
FIG. 5 is a top plan view of the launcher assembly shown in FIG. 4, but without a cover to illustrate an internal spring in its extended configuration.
Figure 6:
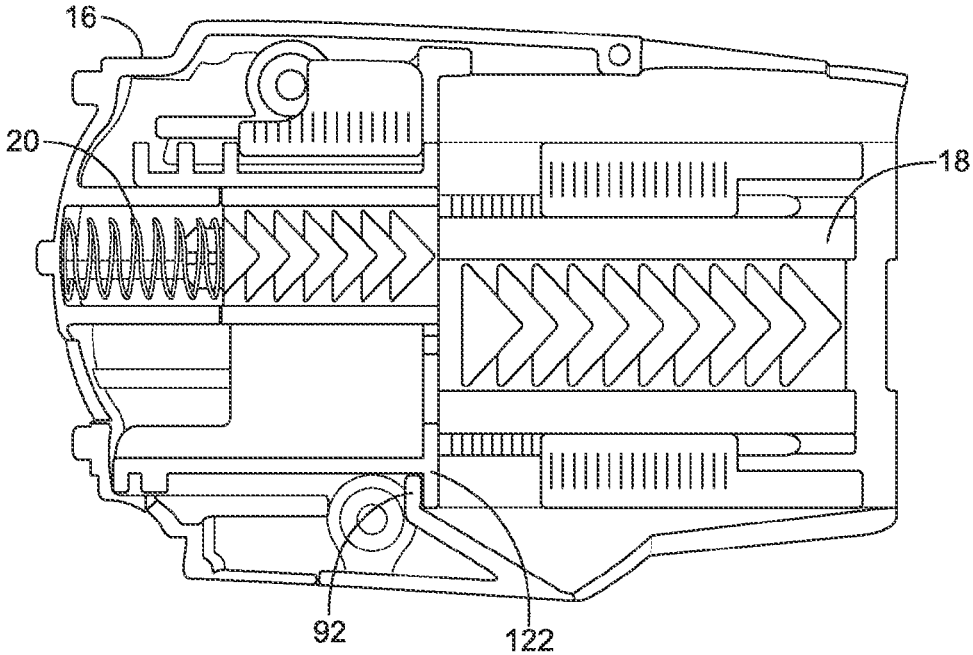
FIG. 6 is a top plan view of the launcher assembly shown in FIG. 5, with the spring in a compressed configuration.
Figure 7:
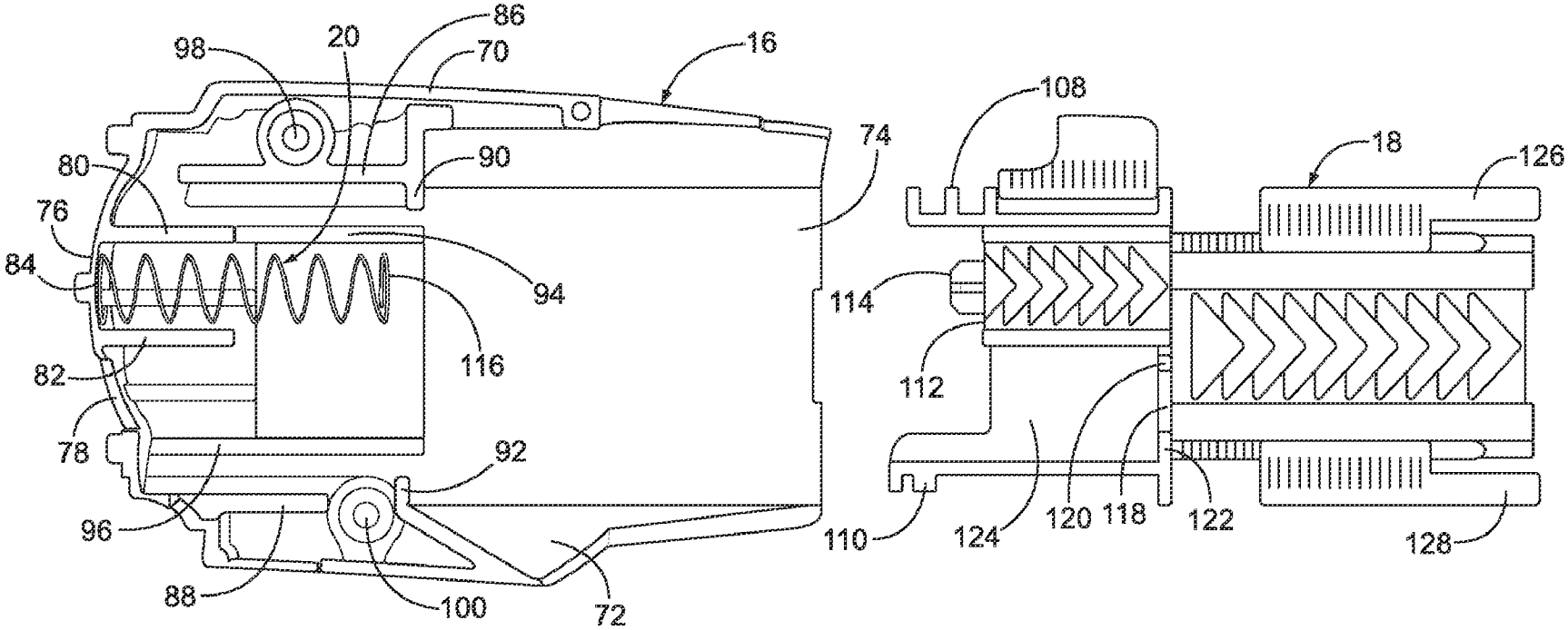
FIG. 7 is a top plan view of the launcher assembly shown in FIG. 5, with two parts of the assembly separated from one another.
Figure 8:
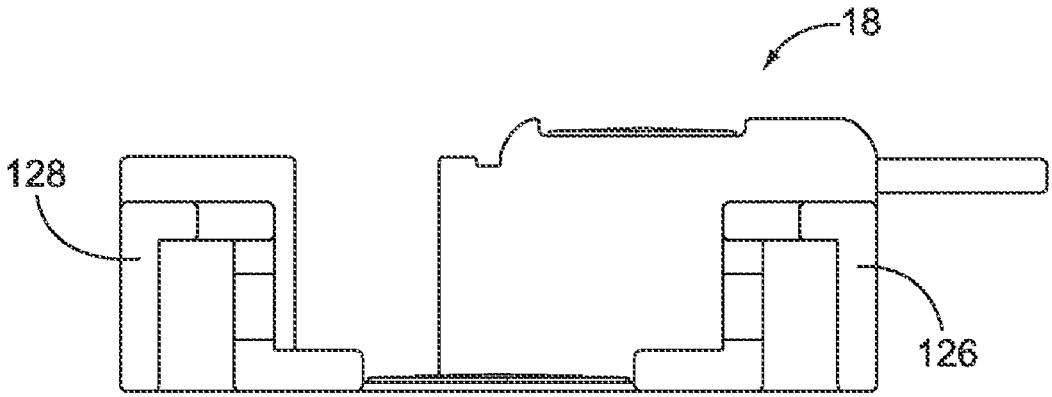
FIG. 8 is a front elevation view of the part of the launcher assembly shown on the right side in FIG. 7.

The launcher apparatus 14 is described in more detail in reference to FIGS. 1, 4-10. The launcher apparatus is formed of the two parts 16, 18, a cover 64, the spring 20, and the pull rack 22. The first or base part 16 is to be held stationary when in operation, such as by a user pressing the base part down against a supporting play surface, such as a floor or table 66. The second or sliding part 18 is engaged to the base part 16 to capture the spring 20 which is mounted between the two parts 16, 18 as shown in FIG. 5. The engagement between the base part and the sliding part also allows the sliding part 18 to move from a first or forward position shown in FIG. 5, rearward to a second position, as shown in FIG. 6, against the spring 20 causing the spring to compress as also shown in FIG. 6. In operation, the sliding part 18 is moved forward under the biasing or expanding force of the compressed spring to launch the toy vehicle.

The base part 16 includes two sidewalls 70, 72, a bottom wall 74, and a back wall 76, with an indentation 78 to accommodate the pull rack 22. The base part 16 also includes two short walls 80, 82 extending longitudinally to constrain, along with the back wall 76, one end 84 of the spring 20, and two longer walls 86, 88, also extending longitudinally to act as guides for the sliding part 18. Two lateral walls 90, 92 function to limit rearward movement of the sliding part 18. A pair of longitudinally extending ribs 94, 96 also help guide longitudinal movement of the sliding part 18. Two openings 98, 100 are provided to receive fasteners for securing the cover 64 to the base part 18.

The launcher sliding part 18 includes two longitudinally extending L-shaped walls 108, 110 for helping guide the sliding part 18 relative to the base part 16. The sliding part 18 also includes a back wall 112 with a post 114 for mounting and constraining a second end 116 of the spring 20, a notch 118 for aligning with the cover 64, two lateral walls 120, 122 to help align the pull rack 22, a bottom wall 124, and two L-shaped arms or supports 126, 128 for engaging and supporting the toy vehicle before launch.

Figure 9:
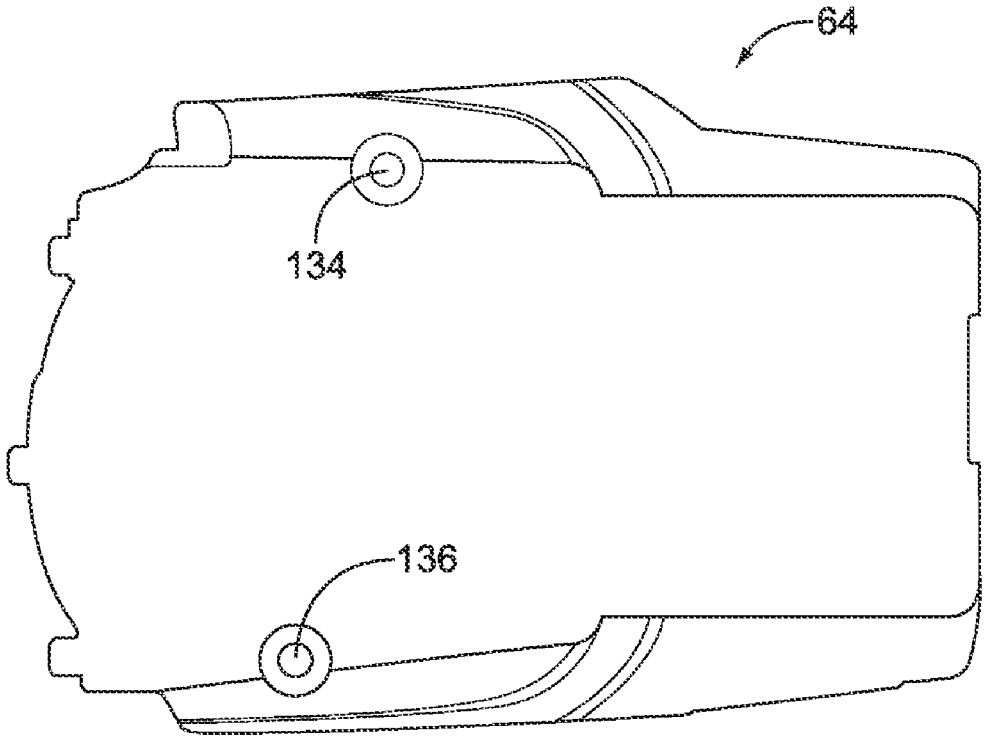
FIG. 9 is a bottom plan view of the launcher assembly cover.

The cover 64 includes a top wall 130, FIG. 4, with a channel 132 for guiding the pull rack 22 and two fastener receiving posts 134, 136, FIG. 9, for aligning with the two openings 98, 100 in the launcher base part 16 to allow the cover 64 to be attached to the base part with fasteners, such as small screws (not shown), and at the same time capture the sliding part 18 between the cover 64 and the base part 16. The base and sliding parts 16, 18 and the cover 64 may be made of any suitable material such as a synthetic resin, and the cover may display design features in keeping with motif of the toy apparatus. For example, the motif of the illustrated preferred embodiment is STAR WARS as seen in FIGS. 1 and 4.

Figure 10:
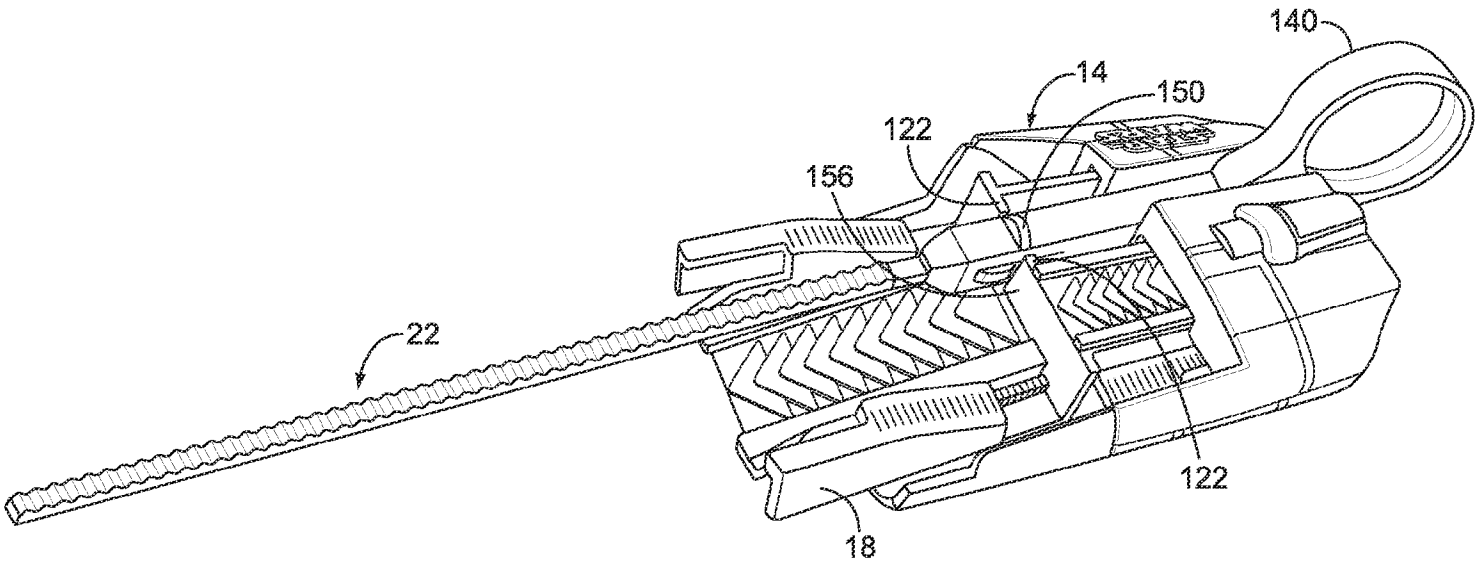
FIG. 10 is an isometric view of the launcher assembly illustrating alignment of the pull rack.
Figure 11:
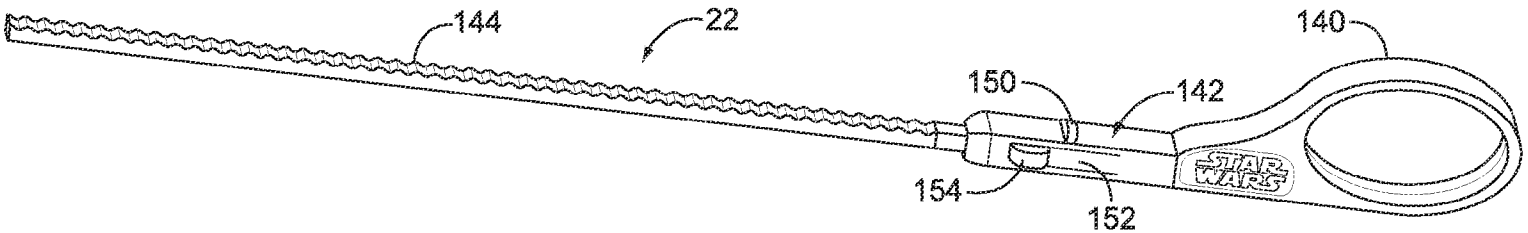
FIG. 11 is an isometric view of the pull rack illustrating a flexible tab with a protrusion at its end portion.

Referring now to FIGS. 10 and 11, the elongated pull rack 22, also called a ripcord, is described in more detail. The pull rack 22 includes a pull ring 140 at one end, an adjacent handle portion 142, and an extended gear teeth portion 144. The pull ring 140, in the alternative, may have any convenient shape, such as a T-shape, or the shape of a cylinder with a roughened exterior surface for assuring a good grip. A good grip on the pull rack allows a user to easily and conveniently grab the pull rack 22 and jerk it rearward rapidly. The extended gear tooth portion 144 is aligned with the pinion gear 36, so that when the pull rack is quickly pulled or jerked rearward the rack's gear teeth engage and spin the pinion gear, and thereby, the flywheel mounted to the same shaft as the pinion gear. At the same time, the pull rack moves the sliding part 18 rearward to the second position to momentarily compress the spring 20 and almost immediately thereafter, to cause the spring to be released to allow the spring to expand.

To accomplish its functions, the handle portion 142 of the pull rack has two important features. First, a rib 150 is formed across the handle portion 142 to help align the pull rack 22 before launch with the lateral walls 120, 122 of the launcher sliding part 18. Second, the handle portion 142 includes a flexible tab 152 having an enlarged end portion or protrusion 154. Before launch, the protrusion 154 engages an outside surface 156 of the lateral wall 122 of the sliding part 18. When the pull rack is quickly pulled or jerked rearward, the protrusion 154 engages and moves the sliding part 18 rearwards to the second position to momentarily compress the spring 20, and the pull rack also starts to energize the flywheel motor of the toy vehicle. As the pull rack continues to be rapidly withdrawn from the base and sliding parts 16, 18, the spring 20 is released because the protrusion 154 is disengaged from the surface 156, while the flywheel motor 32 of the toy vehicle continues to be energized by engagement with the gear teeth portion 144 of the pull rack. These events occur in a very short time span so as to appear to the user to be almost or essentially simultaneous.

The sliding part 18 is able to retract or move rearward to the second position until the lateral walls 120, 122 of the sliding part abut the lateral walls 90, 92 of the base part, thereby causing maximum compression of the spring 20 by the launcher assembly parts 16, 18. Continued pulling on the elongated rack causes the protrusion 154 to cam the flexible tab 152 inward into the handle portion 142 to disengage the protrusion from the lateral wall 122. Once the wall is disengaged from the protrusion, the compressed spring is released and allowed to expand, and the sliding part 18 moves quickly forward to launch the toy vehicle. At the same time, continued pulling of the elongated rack further energizes the flywheel motor with the gear teeth portion 144. Operation of the pull rack energizes both the flywheel motor 32 of the toy vehicle 12, and at the same time, momentarily compresses the spring 20 by moving the sliding part 18 of the launcher apparatus rearward, and thereafter, launches the toy vehicle by releasing the sliding part, and thereby, releasing the compressed spring whose forward motion ejects the toy vehicle from the two L-shaped arms 126, 128 of the sliding part 18. This structural arrangement provides the important feature of boosting the discharge force applied to the toy vehicle, while using elements that are robust, simple, inexpensive and efficient. It is noted that the terms "rearward" and "forward" used above refer to the toy apparatus as it appears in FIG. 1, where rearward is the leftward direction and forward is the rightward direction. It is noted that the view of the launcher assembly shown in FIG. 10 is about one hundred and eighty degrees away from the position shown in FIG. 1. The pull rack may be made of any suitable material such as a synthetic resin.

In operation, the pull rack 22 is threaded through the chassis tubular passageway 54 of the toy vehicle 12 to ensure that the pull rack aligns with the pinion gear 36. Thereafter, the toy vehicle is mounted to the launcher assembly by aligning the L-shaped supports 50, 52, of the toy vehicle with the L-shaped arms 126, 128 of the launcher assembly, and the handle portion 142 of the pull rack is aligned with the lateral walls 120, 122, of the launcher assembly by using the rib 150 on the pull rack. To initiate launch, the launcher assembly, which may be aimed at a distant target, is press against a playing surface, such as the table 66, by one hand of the user, and the pull ring 140 is quickly and forcefully pulled rearward by the user's other hand. The quick rearward motion of the pull rack causes the launcher sliding part 18 to retract or move from the first position to the second position and momentarily compress the spring 20, with the spring being released after the protrusion 154 passes rearward of the lateral wall 120. The pull rack also rotates the flywheel 34 at high velocity, and all three events occur simultaneously and/or in very quick succession so as to be almost or essentially simultaneous from the standpoint of the user.

A method for manufacturing the toy apparatus 10 having the toy vehicle 12 exposed to two forms of propulsion during operation includes the steps of forming the toy vehicle having the internally located flywheel motor 32, and forming a launcher assembly 14, having the base part 16 intended to be held stationary in operation, the slidable part 18 movable relative to the base part, the spring 20 positioned between the base part and the slidable part, and the elongated rack 22. The toy vehicle and the slidable part include structure for mounting the toy vehicle to the slidable part, such that the elongated rack almost simultaneously energizes the flywheel motor and operates the compression and release of the spring.

The important feature of energizing the flywheel motor of the toy vehicle, while compressing and releasing the spring of the launcher assembly provides two power sources for propelling the toy vehicle. The structure described above is simple, robust and relatively inexpensive while providing a toy having excellent play value. The dual power sources are compactly arranged, and operated at the same time in one simple operational motion. The result is that the toy vehicle is propelled with greater thrust and with more accurate aim.

From the foregoing, it can be seen that there has been provided features for an improved toy apparatus and a method for manufacturing the toy vehicle and the launcher assembly. While a particular embodiment of the present invention has been shown and described in detail, and alternatives have been suggested, it will be obvious to those skilled in the art that changes and modifications may be made without departing from the invention in its broader aspects. Therefore, the aim here is to cover all such changes and modifications and alternatives as fall within the true spirit and scope of the invention as expressed in the appended claims. The matters set forth in the foregoing description and accompanying drawings are offered by way of illustrations only and not as claim limitations. The actual scope of the invention is to be defined by the subsequent claims when viewed in their proper perspective based on the prior art.

What is claimed is:

1. A structure to be propelled and launcher apparatus comprising:

a launcher assembly having a first part, a second part slidably mounted to the first part, a spring mounted between the first and second parts for biasing the second part when the spring is compressed, and an elongated rack having gear teeth and a flexible tab with a protrusion; and a structure to be propelled for mounting to the launcher assembly, the structure to be propelled including a flywheel motor comprising a flywheel, wherein the structure is propelled by rapidly expanding the compressed spring and by the flywheel motor which are both operated by the elongated rack wherein operation of the elongated rack causes the flywheel of the flywheel motor to spin and simultaneously causes momentary compression of the spring followed by a release of the compressed spring, the spring is located between a wall of the first part of the launcher assembly and a first wall of the second part of the launcher assembly and before launch the protrusion on the flexible tab of the elongated rack is positioned adjacent a second wall of the second part of the launcher assembly.

2. The apparatus of claim 1, wherein:

operation of the elongated rack causes the protrusion to engage the second wall of the second part of the launcher assembly wherein the spring is compressed and the flywheel of the flywheel motor is rotated.

3. The apparatus of claim 2, wherein:

continued operation of the elongated rack causes the flywheel to continue energizing and the protrusion to bend the tab and disengage from the second wall of the second part of the launcher assembly wherein the second part of the launcher assembly propels the structure as the spring expends.

4. The apparatus of claim 1, wherein:

the second part of the launcher assembly includes a channel for aligning the elongated rack; and the structure to be propelled includes a passageway for receiving the elongated rack.

5. The apparatus of claim 1, said second part comprising mounting arms thereof wherein:

the structure to be propelled comprises a toy vehicle includes mounting supports to engage the mounting arms of the second part of the launcher assembly.

6. The apparatus of claim 1, wherein:

the structure to be propelled is mounted to position the flywheel motor spaced away from the launcher assembly;

the spring is located between a wall of the first part of the launcher assembly and a first wall of the second part of the launcher assembly;

before launch the protrusion of the flexible tab of the elongated rack is positioned adjacent a second wall of the second part of the launcher assembly; and operation of the elongated rack causes a flywheel of the flywheel motor to spin and simultaneously causes momentary compression of the spring followed by a release of the compressed spring.

7. The apparatus of claim 6, wherein:

continued operation of the elongated rack causes the flywheel to continue energizing and the protrusion to bend the tab and disengage from the second wall of the second part of the launcher assembly wherein the second part of the launcher assembly propels the structure as the spring expands.

8. The apparatus of claim 7, wherein:

the second part of the launcher assembly includes a channel for aligning the elongated rack;

the structure to be propelled includes a passageway for receiving the elongated rack; and the toy vehicle includes mounting supports to engage mounting arms of the second part of the launcher assembly.

9. A toy vehicle and launcher apparatus comprising:

a toy vehicle having a flywheel motor and support structure; and a launcher assembly having a first part intended to remain stationary during operation, a second part slidably mounted to the first part and movable between first and second positions, the second part having structure for supporting the toy vehicle at the time of launch, a spring mounted between the first and second parts for biasing the second part when the spring is compressed from the second position to the first position, an elongated rack having gear teeth and a flexible tab with a protrusion for engaging the second part of the launcher assembly, wherein during operation the elongated rack moves the second part of the launcher assembly from the first position to the second position for compressing the spring by the protrusion bearing against the second part, wherein after the spring is compressed the protrusion bends the tab to disengage the protrusion from the second part, wherein the elongated rack spins a flywheel of the flywheel motor, and wherein toy vehicle is propelled away from the launcher assembly first by the compressed spring expanding and second by the flywheel motor.

10. The apparatus of claim 9, wherein:

the elongated rack compresses the spring momentarily as the elongated rack pulls the second part of the launcher assembly from the first position to the second position and before the elongated rack releases the second part of the launcher assembly.

11. The apparatus of claim 10, wherein:

the elongated rack simultaneously spins the flywheel motor when the elongated rack compresses the spring.

12. The apparatus of claim 11, wherein:

the toy vehicle is mounted at launch to position the flywheel spaced away from the launcher assembly.

13. A toy vehicle and launcher apparatus comprising:

a support structure for the toy vehicle;

a flywheel motor on said support structure;

a first part of the launcher;

a second part on the first part, where the second part has a first position and a second position on the first part;

a spring between said first part and said second part;

an elongated rack having gear teeth and a flexible tab with a protrusion, the gear teeth of said elongated rack being coupled with the flywheel motor; and a wall on said second part positioned at the protrusion of the flexible tab at the second position of the second part on the first part with said support structure at said second part.

14. The apparatus of claim 13, wherein:

said elongated rack compresses the spring.

15. The apparatus of claim 14, wherein:

said elongated rack moves the second part of the launcher assembly from the first position to the second position of the launcher assembly.

16. A structure to be propelled and launcher apparatus comprising:

a launcher assembly having a first part, a second part comprising mounting arms thereof with the second part slidably mounted to the first part, a spring mounted between the first and second parts for biasing the second part when the spring is compressed, and an elongated rack having gear teeth; and a structure to be propelled for mounting to the launcher assembly, the structure to be propelled including a flywheel motor, wherein the structure is propelled by rapidly expanding the compressed spring and by the flywheel motor which are both operated by the elongated rack, wherein the structure includes mounting supports to engage the mounting arms of the second part of the launcher assembly wherein operation of the elongated rack causes a flywheel of the flywheel motor to spin and simultaneously causes momentary compression of the spring followed by a release of the compressed spring.

17. The apparatus of claim 16, wherein the flywheel motor includes a pinion gear mounted adjacent the flywheel in the structure to be propelled.

18. The apparatus of claim 17, wherein the structure is mounted to position the flywheel spaced away from the launcher assembly.

19. The apparatus of claim 16, comprising a wall on said launcher assembly where the second part slidably mounted to the first part to guide and limit the second part on the first part.

* * * * *